US010273865B2

(12) United States Patent
Vianney

(10) Patent No.: US 10,273,865 B2
(45) Date of Patent: Apr. 30, 2019

(54) COOLING AND LUBRICATING SYSTEM FOR A PISTON SEALING DEVICE

(71) Applicant: Rabhi Vianney, Lyons (FR)

(72) Inventor: Rabhi Vianney, Lyons (FR)

( * ) Notice: Subject to any disclaimer, the term of this patent is extended or adjusted under 35 U.S.C. 154(b) by 156 days.

(21) Appl. No.: 15/386,320

(22) Filed: Dec. 21, 2016

(65) Prior Publication Data

US 2017/0184009 A1 Jun. 29, 2017

Related U.S. Application Data

(60) Provisional application No. 62/387,216, filed on Dec. 24, 2015.

(51) Int. Cl.

| | |
|---|---|
| ***F04B 53/18*** | (2006.01) |
| ***F01P 3/06*** | (2006.01) |
| ***F04B 1/12*** | (2006.01) |
| ***F04B 1/20*** | (2006.01) |
| ***F04B 53/16*** | (2006.01) |
| ***F03C 1/28*** | (2006.01) |
| ***F03C 1/32*** | (2006.01) |

(52) U.S. Cl.

CPC ..... *F01P 3/06* (2013.01); *F03C 1/0605* (2013.01); *F03C 1/0652* (2013.01); *F04B 1/124* (2013.01); *F04B 1/2035* (2013.01); *F04B 53/166* (2013.01); *F04B 53/18* (2013.01)

(58) Field of Classification Search

CPC ..... F04B 1/2035; F04B 1/124; F04B 53/166; F04B 53/18; F01P 3/06; F03C 1/0605; F03C 1/0652

See application file for complete search history.

(56) References Cited

U.S. PATENT DOCUMENTS

| | | | | |
|---|---|---|---|---|
| 3,828,654 A * | 8/1974 | Wiethoff | ..... | F04B 1/124 91/488 |
| 4,852,463 A * | 8/1989 | Wagenseil | ..... | F04B 1/124 91/488 |
| 6,092,457 A * | 7/2000 | Inoue | ..... | F04B 1/124 92/129 |
| 6,732,633 B1 * | 5/2004 | Betz | ..... | F04B 1/124 92/172 |

* cited by examiner

*Primary Examiner* — Abiy Teka
(74) *Attorney, Agent, or Firm* — Young & Thompson

(57) ABSTRACT

The cooling and lubricating system is provided for a piston sealing device for a piston, which includes a fixed skirt and a sliding skirt joined together by an interskirt mechanical connection to axially compress a continuous extensible segment under the action of a sliding skirt spring. The system adds to the device a sliding skirt thrust ring so as to insert between the fixed skirt and the continuous extensible segment a flow valve traversed by the interskirt mechanical connection. The valve is held at rest away from the fixed skirt by a valve return spring on the one hand, and including a flow calibration orifice on the other hand.

7 Claims, 4 Drawing Sheets

COOLING AND LUBRICATING SYSTEM FOR A PISTON SEALING DEVICE

FIELD OF THE INVENTION

The present invention concerns a cooling and lubricating system for a piston sealing device. The invention is an improvement on the piston sealing device which is the subject matter of patent application FR 3009037 dated 23 Jul. 2013 belonging to the applicant. The device is particularly adapted to any piston operating under high pressure.

BACKGROUND OF THE INVENTION

The piston sealing device according to patent application FR 3009037 is designed for a piston moving in a cylinder one of whose ends is closed by a fluid chamber, said piston comprising at least one piston head having at least one fixed skirt, said head having on the one hand a piston bearing surface to exert a force on any means of mechanical, hydraulic, or pneumatic transmission and, on the other hand, a compression surface opening into the fluid chamber and able to receive the pressure of a fluid.

Again according to the patent application FR 3009037, the piston sealing device comprises a sliding skirt of cylindrical shape lodged in a chamber with slight gap. This skirt is moreover placed as a prolongation of the piston head on the side with the compression surface and in the axis of said head.

It will be noted that said sliding skirt is connected to said head by a mechanical interskirt connection which allows it to move in longitudinal translation with respect to said head, however a pressure transmission channel devised inside the sliding skirt passes straight through the latter in the axial direction.

The invention of patent application FR 3009037 is likewise characterized by a continuous extensible segment of continuous annular shape which is inserted between the fixed skirt and the sliding skirt. This segment comprises an internal cylindrical segment face subjected to the pressure of the fluid via the pressure transmission channel, an external cylindrical segment face able to make contact with the cylinder, an axial segment face on the fixed skirt side held directly or indirectly in tight contact with the fixed skirt and an axial segment face on the sliding skirt side held directly or indirectly in tight contact with the sliding skirt.

Finally, the invention regarding patent application FR 3009037 is also characterized by a sliding skirt spring which tends to bring the sliding skirt closer to the fixed skirt and to axially compress the continuous extensible segment or at least prevent said sliding skirt from moving away from the fixed skirt in the manner of an end stop.

Upon perusal of patent FR 3009037, one understands that the maximum leakage rate of fluid flowing between the piston and the cylinder occurs when the pressure prevailing in the fluid chamber is high enough to maximize the flow rate of fluid moving in the gap left between the sliding skirt and the cylinder, but not yet high enough for the continuous extensible segment to be pressed in circumferential contact against the cylinder, realizing a nearly total tightness.

Thus, according to the piston sealing device per the patent application FR 3009037, a leakage thus exists in transitory manner between the piston and the cylinder. This leakage is furthermore added to that which occurs during the low-pressure phase found during the delivery stroke of a hydraulic motor or during the aspiration stroke of a hydraulic pump. In fact, during this phase, the continuous extensible segment is parked and does not provide any tightness other than that consisting in the restriction of the movement of fluid formed by the gap left between said segment and the cylinder.

This leakage is necessary to the lubricating and cooling of the continuous extensible segment, on the one hand, and the piston on the other.

Depending on the type of pump or hydraulic motor for which the piston sealing device of patent application FR 3009037 is being used, the need for lubricating and cooling fluid may vary, especially depending on the magnitude of the radial force exerted by the piston on the cylinder.

In fact, the larger this force, the more energy is dissipated by friction and shear of oil at the interface between the piston and the cylinder. In order to carry away this energy, there must be sufficient oil circulating.

Moreover, the need for lubricating oil tends to increase with said force, since there must be guaranteed in all circumstances a sufficient thickness of the oil film separating the piston and the cylinder, so as to prevent any metal on metal contact between said piston and said cylinder.

Furthermore, it will be noted that certain pumps or certain hydraulic motors comprise mechanical parts which are positioned opposite the fluid chamber receiving the fluid under pressure and which are lubricated and/or cooled thanks to the leakage flow between the piston and the cylinder.

The pronounced tightness of the piston sealing device according to patent application FR 3009037 may at times cause a problem of insufficient lubricating and/or cooling rate both for the piston itself and for any mechanical parts with which the piston is cooperating.

One solution might involve placing one or more oil injectors in various locations of the pump or hydraulic motor casing to lubricate and/or cool the components just mentioned. The problem is that such injectors would inevitably complicate the hydraulic pump or the hydraulic motor receiving them. Moreover, the lubrication of the piston in its cylinder may still be inadequate, since the flow rate of oil furnished by such injectors must reach parts of the cylinder made inaccessible by the piston.

The cooling and lubricating system for a piston sealing device according to the invention is thus addressed primarily to the pumps and hydraulic motors outfitted with the piston sealing device according to patent application FR 3009037 whose flow of lubricating and cooling fluid has become inadequate due to the pronounced tightness realized by this device.

SUMMARY OF THE INVENTION

Accordingly, in one type of application, the cooling and lubricating system for a piston sealing device according to the invention makes it possible, depending on its implementation:

- To generate a substantial leakage flow of lubricating and cooling oil at the cost of a minimal reduction in the volume and energy performance of the hydraulic pump or the hydraulic motor receiving it;
- To avoid the providing of one or more lubricating and cooling injectors in the casing of any pump or hydraulic motor receiving the piston sealing device according to patent application FR 3009037;
- To provide a flow of lubricating and cooling oil at the interface between the piston and the cylinder, in zones usually inaccessible to the oil jet of an oil injector;

To increase only very marginally the cost price for manufacture of the piston of a pump or hydraulic motor receiving the piston sealing device according to patent application FR 3009037.

It is understood that, beyond its application to hydraulic pumps and hydraulic motors with axial or radial pistons, the cooling and lubricating system for a piston sealing device according to the invention can be applied to any other pump, motor, motor/pump set or hydraulic or pneumatic jack whose configuration advantageously allows for the use of said system.

The other characteristics of the present invention have been described in the description and in the secondary claims directly or indirectly dependent on the main claim.

The cooling and lubricating system according to the present invention is provided for a piston sealing device, the latter being itself provided for a piston moving in a cylinder so as to form a fluid chamber, said piston comprising a piston head having a fixed skirt and comprising on the one hand a piston bearing surface to exert a force on means of transmission and, on the other hand, a compression surface opening into the fluid chamber to receive the pressure of a fluid, while a sliding skirt is lodged in the cylinder with slight gap, in a prolongation of the piston head on the side with the compression surface and in the axis of said head, said sliding skirt being connected to said head by a mechanical interskirt connection, while a pressure transmission channel is devised inside the sliding skirt and passes straight through the latter in the axial direction, the piston sealing device also comprising a continuous extensible segment inserted between the fixed skirt and the sliding skirt, said segment comprising an internal cylindrical segment face subjected to the pressure of the fluid via the pressure transmission channel, an external cylindrical segment face able to make contact with the cylinder, an axial segment face on the fixed skirt side held directly or indirectly in tight contact with the fixed skirt and an axial segment face on the sliding skirt side held directly or indirectly in tight contact with the sliding skirt, even through a sliding skirt spring tends to bring the sliding skirt closer to the fixed skirt and to axially compress the continuous extensible segment, said system comprising:

At least one sliding skirt thrust ring which prevents the sliding skirt from moving a certain distance away from the piston;

At least one flow valve traversed axially and more or less in tight manner by the interskirt mechanical connection and inserted between the continuous extensible segment and the piston head, said valve comprising as its first part an axial valve face on the piston head side having a circular bearing surface for flow closure, the latter defining with a valve contact surface devised on the compression surface a circular contact line whose diameter is significantly less than that of the cylinder, said valve comprising as its second part an axial valve face on the sliding skirt side held directly or indirectly in tight contact with the continuous extensible segment, said valve comprising as its third part a flow calibration orifice passing straight through said valve in the axial direction;

At least one intermediate fluid exit chamber whose volume is formed—inside the circular line of contact—by the axial valve face on the piston head side, by the compression surface, and by the external surface of the interskirt mechanical connection;

At least one valve return spring which tends to move the flow valve away from the piston head.

The cooling and lubricating system according to the present invention comprises a valve return spring which acts as a sliding skirt spring.

The cooling and lubricating system according to the present invention comprises a flow calibration orifice which consists of the gap left between the flow valve and the interskirt mechanical connection.

The cooling and lubricating system according to the present invention comprises a valve return spring which is lodged inside the intermediate fluid exit chamber.

The cooling and lubricating system according to the present invention comprises a sliding skirt spring which is lodged inside a spring cup devised in or attached to the sliding skirt.

The cooling and lubricating system according to the present invention comprises a sliding skirt thrust ring which is traversed straight through by at least one fluid passage orifice.

The cooling and lubricating system according to the present invention comprises an external cylindrical face of the piston head having a circular decompression groove which limits the tightness of said head.

BRIEF DESCRIPTION OF THE DRAWINGS

The following description in regard to the enclosed drawings, given as nonlimiting examples, will enable a better understanding of the invention, its characteristics, and the advantages which it is able to provide.

DETAILED DESCRIPTION OF THE INVENTION

Figure 1:
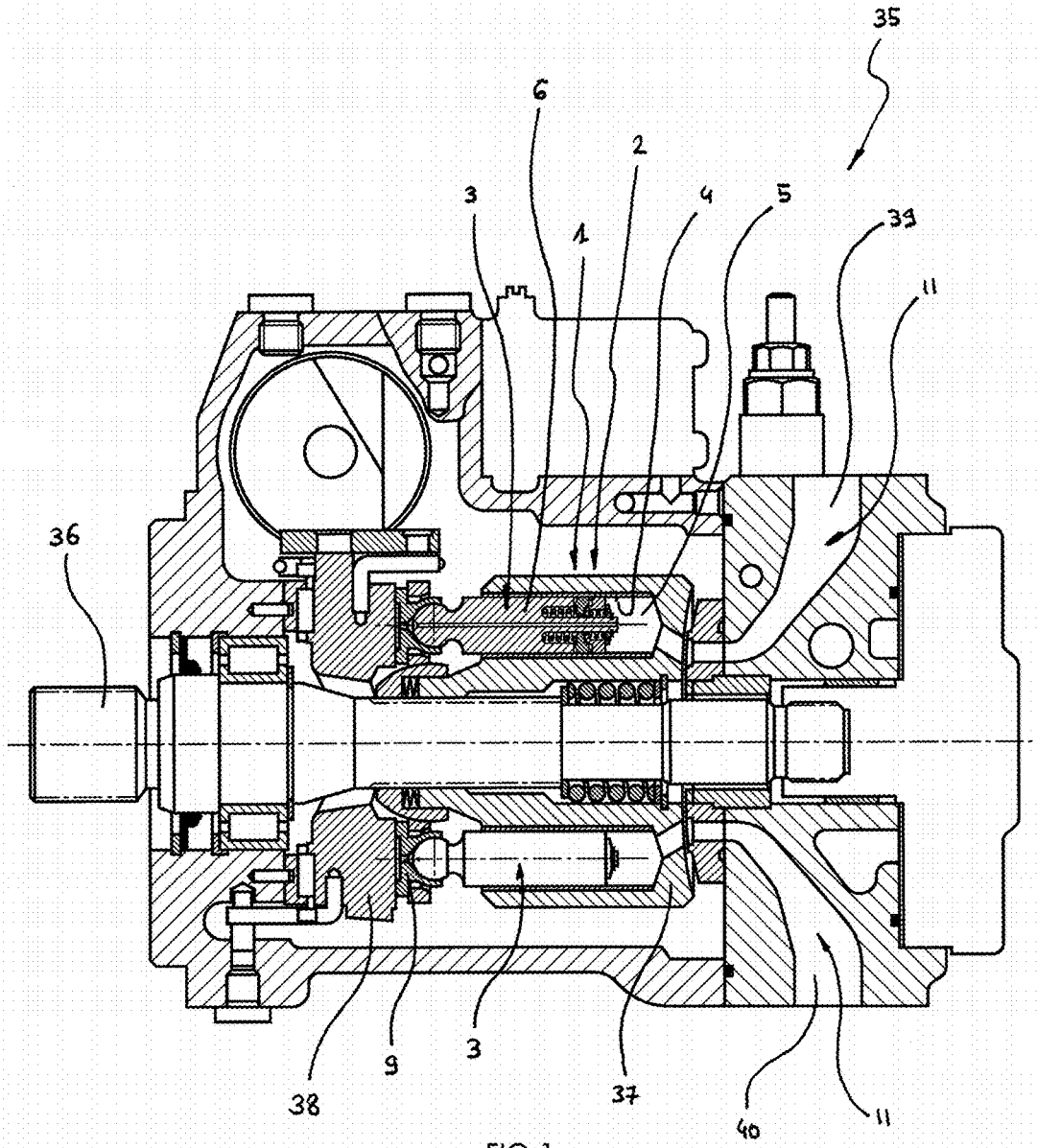
FIG. 1 is a schematic sectional view of a hydraulic pump with axial pistons and variable cylinder capacity whose pistons receive the cooling and lubricating system according to the invention.
Figure 2:
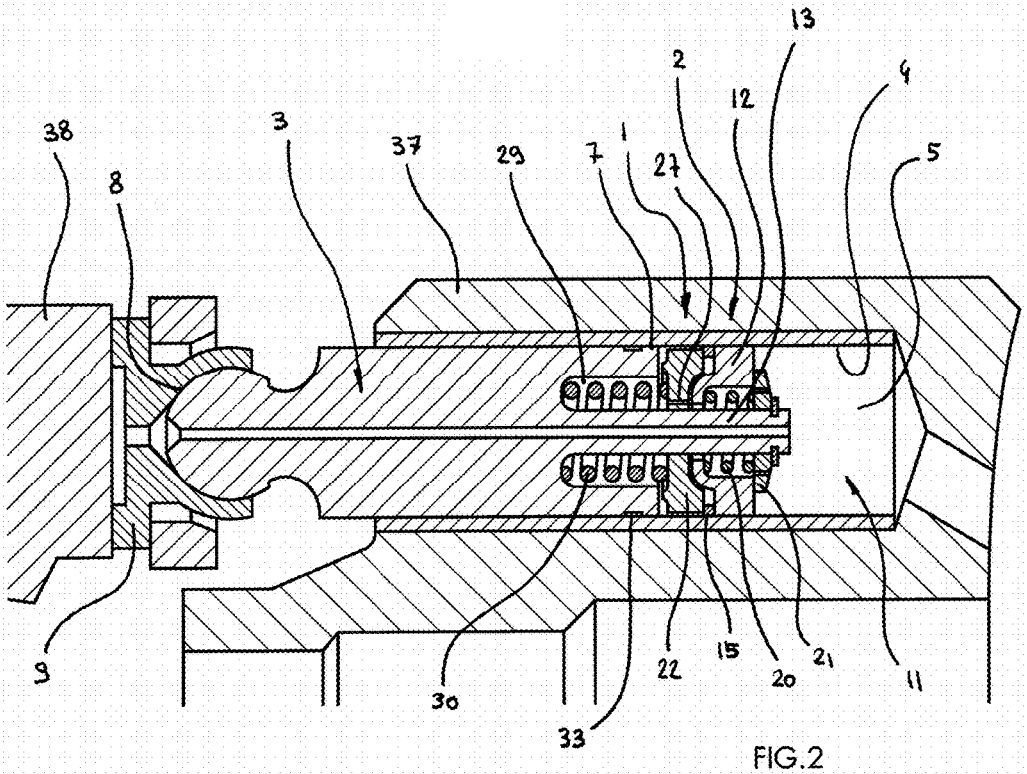
FIG. 2 is a schematic sectional view of the cooling and lubricating system according to the invention.

There is shown in FIGS. 1 to 7 the cooling and lubricating system 1 for a piston sealing device 2, various details of its components, its variants, and its accessories.

The cooling and lubricating system 1 is provided for a piston sealing device 2, the latter being itself provided for a piston 3 moving in a cylinder 4 so as to form a fluid chamber 5, said piston 3 comprising a piston head 6 having a fixed skirt 7 and presenting on the one hand a piston bearing surface 8 to exert a force on means of transmission 9 and, on the other hand, a compression surface 10 opening into the fluid chamber 5 to receive the pressure of a fluid 11.

The piston sealing device 2 to which the cooling and lubricating 1 system according to the invention is applied moreover comprises a sliding skirt 12 which is lodged in the cylinder 4 with a slight gap, in a prolongation of the piston head 6 on the compression surface side 10 and in the axis of said head 6, said sliding skirt 12 being connected to said head 6 by an interskirt mechanical connection 13, while a pressure transmission channel 14 is devised inside the sliding skirt 12 and crosses straight through the latter in the axial direction.

The piston sealing device 2 to which the cooling and lubricating 1 system according to the invention is applied also comprises a continuous extensible segment 15 inserted between the fixed skirt 7 and the sliding skirt 12, said segment 15 comprising an internal cylindrical segment face 16 subjected to the pressure of the fluid 11 via the pressure transmission channel 14, an external cylindrical segment face 17 able to make contact with the cylinder 4, an axial segment face on the fixed skirt side 18 held directly or indirectly in tight contact with the fixed skirt 7 and an axial segment face on the sliding skirt side 19 held directly or indirectly in tight contact with the sliding skirt 12 even through a sliding skirt spring 20 tends to bring the sliding skirt 12 closer to the fixed skirt 7 and to axially compress the continuous extensible segment 15.

As is shown by FIGS. 1 to 5 and FIG. 7, the cooling and lubricating system 1 for a piston sealing device 2 according to the invention comprises at least one sliding skirt thrust ring 21 which prevents the sliding skirt 12 from moving a certain distance away from the piston 3.

FIGS. 1 to 7 illustrates that the cooling and lubricating system 1 for a piston sealing device 2 according to the invention comprises at least one flow valve 22 traversed axially and in more or less tight manner by the interskirt mechanical connection 13 and inserted between the continuous extensible segment 15 and the piston head 6.

Said valve 22 comprises as its first part an axial valve face on the piston head side 23 having a circular bearing surface for flow closure 24, the latter defining with a valve contact surface 26 devised on the compression surface 10 a circular contact line 25 whose diameter is significantly less than that of the cylinder 4.

Said valve 22 comprises as its second part an axial valve face on the sliding skirt side 28 held directly or indirectly in tight contact with the continuous extensible segment 15.

Said valve 22 comprises as its third part a flow calibration orifice 27 passing straight through said valve 22 in the axial direction.

It is noted that, according to one particular embodiment of the cooling and lubricating system 1 of the invention, the flow valve 22 can be held radially centered in the cylinder 4 by the interskirt mechanical connection 13 around which it is mounted with a slight gap, such that the exterior cylindrical surface of that valve 22 remains at a certain distance from the internal wall of the cylinder 4 without ever making contact with that wall.

As is illustrated clearly by FIGS. 1 to 5, the cooling and lubricating system 1 for a piston sealing device 2 according to the invention comprises at least one intermediate fluid exit chamber 29 whose volume is formed—inside the circular line of contact 25—by the axial valve face of the piston head side 23, by the compression surface 10 and by the external surface of the interskirt mechanical connection 13.

Finally, FIGS. 1 to 5 and FIG. 7 show that the cooling and lubricating system 1 for a piston sealing device 2 according to the invention comprises at least one valve return spring 30 which tends to move the flow valve 22 away from the piston head 6.

Figure 3:
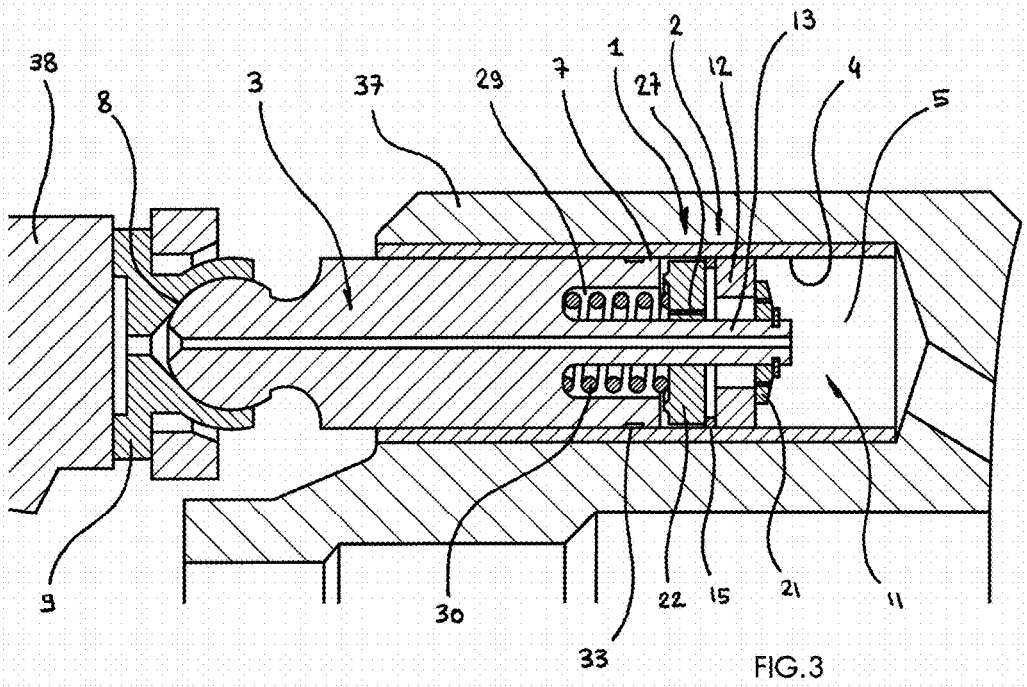
FIG. 3 is a schematic sectional view of the cooling and lubricating system according to the invention whose valve return spring acts as a sliding skirt valve.

FIG. 3 shows that the cooling and lubricating system 1 for a piston sealing device 2 according to the invention calls for the valve return spring 30 being able to act as a sliding skirt spring 20.

In fact, the valve return spring 30 tends to bring the flow valve 22 closer to the sliding skirt 12 and to axially compress the continuous extensible segment 15 between said valve 22 and said skirt 12 in the manner of the piston sealing device according to patent application FR 3009037.

This replacement may prove to be acceptable especially when the cooling and lubricating system 1 for a piston sealing device 2 according to the invention is applied to certain hydraulic pumps.

As a variant, the flow calibration orifice 27 can be constituted by the gap left between the flow valve 22 and the interskirt mechanical connection 13, said gap being calculated to let pass the desired fluid flow 11 from the fluid chamber 5 to the intermediate fluid exit chamber 29.

FIGS. 1 to 5 and FIG. 7 show that the valve return spring 30 can be lodged inside the intermediate fluid exit chamber 29, said spring 30 being possibly of the helicoidal, compression, traction or torsion type, comprised of one or more Belleville washers stacked in series or in parallel, or a type familiar to the skilled person.

As is shown by FIGS. 1, 2, 4, 5 and 7, the sliding skirt spring 20 can be lodged inside a spring cup 31 devised in or attached to the sliding skirt 12, said spring 30 being possibly of the helicoidal, compression, traction or torsion type, comprised of one or more Belleville washers stacked in series or in parallel, or a type familiar to the skilled person.

Figure 4:
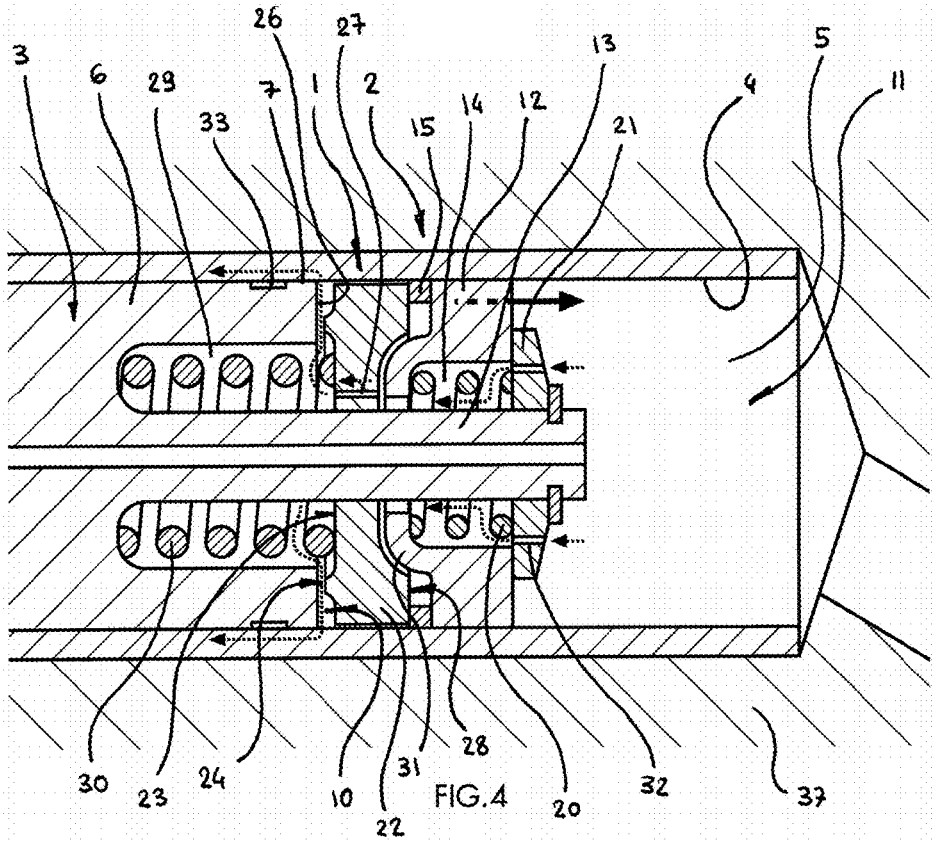
FIGS. 4 and 5 are schematic sectional views illustrating the functioning of the cooling and lubricating system according to the invention, the pressure prevailing in the fluid chamber being respectively low, then high.
Figure 5:
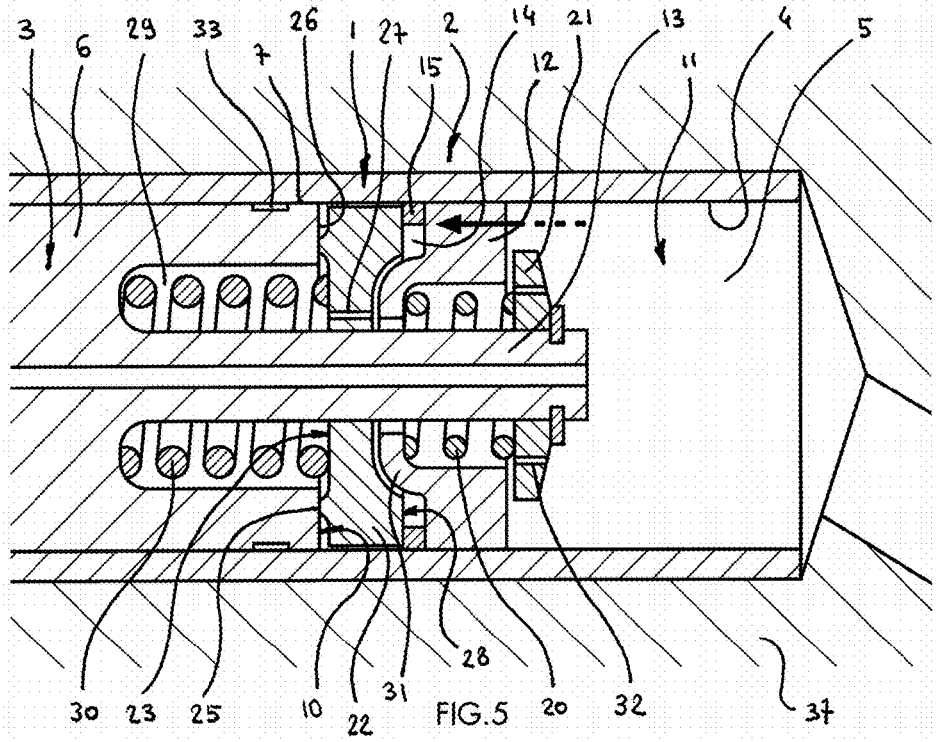

It is particularly visible in FIGS. 4 and 5 that, according to the cooling and lubricating system 1 for a piston sealing device 2 according to the invention, the sliding skirt thrust ring 21 can be traversed straight through by at least one fluid passage orifice 32 which lets the fluid 11 contained in the fluid chamber 5 pass freely through said ring 21 on the one hand to exert a pressure on the internal cylindrical segment face 16 and on the other hand to cool and lubricate the piston 3, emerging from the intermediate fluid exit chamber 29 after having entered into the latter, in particular via the flow calibration orifice 27.

Figure 6:
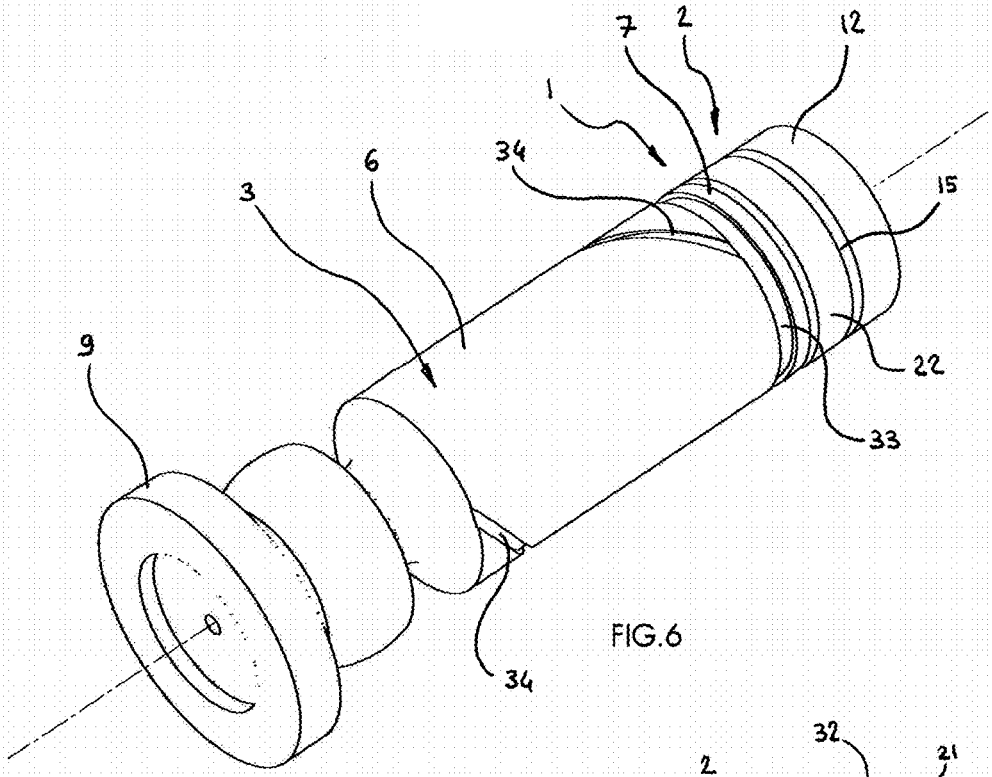
FIG. 6 is a three-dimensional view of an assembled piston which is outfitted with the cooling and lubricating system according to the invention, and the piston sealing device which it improves.
Figure 7:
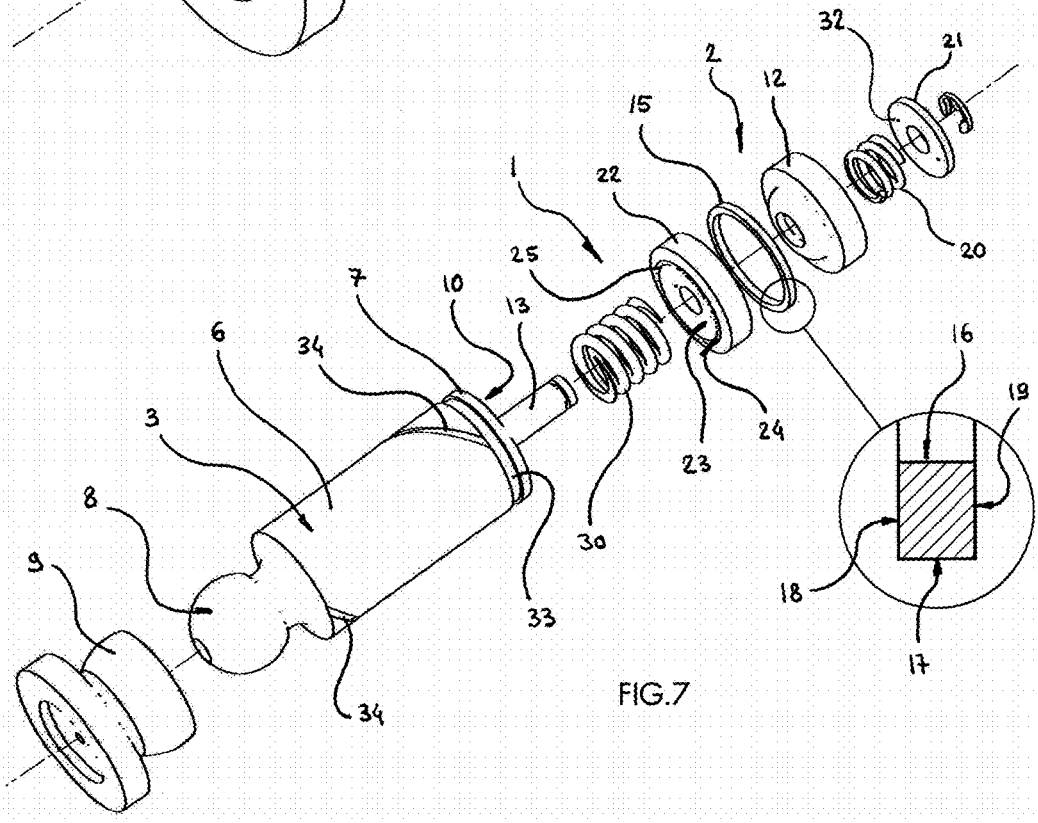
FIG. 7 is a three-dimensional exploded view of a piston which is outfitted with the cooling and lubricating system according to the invention, and the piston sealing device which it improves.

As is seen in FIGS. 2 to 7, the exterior cylindrical face of the piston head 6 can have a circular decompression groove 33 which limits the tightness of said head 6, thereby promoting the functioning of the continuous extensible segment 15, said circular groove 33—according to one particular embodiment of the articulated coupling 1 according to the invention—being able to cooperate with at least one axial decompression groove 34 as is shown in FIGS. 6 and 7, connecting said circular groove 33 to the piston bearing surface 8.

It will be noted that advantageously the axial decompression groove 34 may be helicoidal in order to distribute the bearing pressure exerted by the exterior cylindrical surface of the piston head 6 on the cylinder 4.

FUNCTIONING OF THE INVENTION

The functioning of the cooling and lubricating system 1 for a piston sealing device 2 according to the invention will be easily understood by looking at FIGS. 1 to 7.

FIG. 1 shows the cooling and lubricating system 1 applied to a hydraulic pump with axial pistons and variable cylinder capacity 35 which is known in itself. It is noted that the pistons 3 of said pump 35 are of course outfitted with the piston seal 2 which is the subject matter of patent application FR 3009037 which is improved by the cooling and lubricating system 1 according to the invention.

When a transmission shaft 36 of said pump 35 is placed in rotation by a driving source, not shown, said shaft 36 in turn causes a barrel 37 to rotate, which is integrated with said shaft 36.

When a tilting plate 38 provided by said pump 35 is tilted, at the same time the pistons 3 of said pump 35 begin to move back and forth in the cylinder 4 with which they cooperate. The result is that said pistons 3 aspirate fluid 11 into an admission line 39 which is fed by that fluid 11 at a low pressure of ten bars, for example, and then expel that fluid 11 into a delivery line 40 in which the fluid 11 is brought up to a pressure of four hundred bars, for example.

According to what is specified in patent application FR 3009037 regarding the piston sealing device 2, the continuous extensible segment 15 of each piston 3 passes in succession from the parked state, when the pressure prevailing in the fluid chamber 5 with which it cooperates is ten bars, to the state of tight contact with the cylinder 4 when the pressure prevailing in said chamber 5 is four hundred bars.

The profound tightness realized by the continuous extensible segment 15 with the cylinder 4 when the pressure prevailing in the fluid chamber 5 is four hundred bars only lets through very little fluid 11 between said segment 15 and said cylinder 4. Likewise, when the pressure prevailing in the fluid chamber 5 is only ten bars, even though said segment 15 is parked, the slight gap left between the sliding skirt 12 and the cylinder 4 on the one hand, and between the continuous extensible segment 15 and that same cylinder 4 on the other hand, only lets escape very little fluid 11 from the fluid chamber 5 via the gap left between the piston 3 and the cylinder 4.

Therefore, the cooling and the lubricating of the piston 3 may need more fluid 11 than is let through by the continuous extensible segment 15 and the sliding skirt 12 with which it cooperates. This is why—as is clearly shown by FIG. 4—according to the cooling and lubricating system 1 of the invention it is permitted for supplemental fluid 11 to pass directly from the fluid chamber 5 to the space constituting the gap left between the piston 3 and the cylinder 4 without passing either through the gap left between the sliding skirt 12 and the cylinder 4 or through the gap left between the continuous extensible segment 15 and that same cylinder 4.

According to the cooling and lubricating system 1 according to the invention, said supplemental fluid 11 can in fact pass successively via the fluid passage orifice 32 devised in the sliding skirt thrust ring 21, the pressure transmission channel 14, the flow calibration orifice 27, the intermediate fluid exit chamber 29 and the gap left between the flow closure circular bearing surface 24 and the valve contact surface 26. It will be noted that the latter gap only exists when the pressure prevailing in the fluid chamber 5 is low, or only in the vicinity of ten bars, according to the example used here.

In fact, as is shown by FIG. 4, when the pressure prevailing in the fluid chamber 5 is low, the force exerted by the fluid pressure 11 against the axial valve face on the sliding skirt side 28 is less than the force exerted by the valve return spring 30 on the axial valve face on the piston head side 23.

Consequently, the flow valve 22 remains at a distance from the piston 3 and the gap left between the piston 3 and the cylinder 4 is fed with fluid 11 designed to cool and lubricate the piston 3. It will be noted that the diameter and the length of the flow calibration orifice 27 are provided to produce the necessary head loss in order to achieve the desired fluid flow 11 at low pressure.

It will also be noted that the force exerted by the pressure of the fluid 11 against the axial valve face on the sliding skirt side 28 corresponds approximately to the product of the pressure of that fluid 11 and the cross section area of the cylinder 4 less that area defined by the interior of the flow closure circular bearing surface 24.

Thus, the pressure prevailing in the fluid chamber 5 above which the flow valve 22 is closed—that is, above which the flow closure circular bearing surface 24 is in contact with the valve contact surface 26—depends on the ratio existing between the dead weight and the stiffness of the valve return spring 30 on the one hand and the area defined by the interior of the flow closure circular bearing surface 24 on the other hand.

It will be understood that, at low pressure, the continuous extensible segment 15 is held strongly compressed between the flow valve 22 and the sliding skirt 12, since the force produced by the valve return spring 30 is significantly greater than that produced by the sliding skirt valve 20.

As soon as the pressure prevailing in the fluid chamber 5 crosses the threshold for movement of the flow valve 22—as illustrated by FIG. 5—the sliding skirt 12 lifts off from the sliding skirt thrust ring 21 and the continuous extensible segment 15 is no longer held compressed by only the sliding skirt valve 20. That segment 15 can then operate under conditions identical to those provided by the piston sealing device 2 as specified in the patent application FR 3009037.

If the cooling and lubricating system 1 according to the invention is designed so that the force exerted by the fluid pressure 11 on the axial valve face on the sliding skirt side 28 becomes greater than the force exerted by the valve return spring 30 on the axial valve face on the piston head side 23 starting at a pressure of fifteen bars prevailing in the fluid chamber 5 and the flow valve 22, taking into account of the stiffness of the valve return spring 30, is totally closed at twenty five bars, then fluid 11 designed to cool and lubricate the piston 3 will pass through the flow calibration orifice 27 once the pressure prevailing in the fluid chamber 5 is between a few millibars and twenty five bars.

Thus, the ratio between the flow rate of cooling and lubricating fluid 11, on the one hand, and the pressure prevailing in the fluid chamber 5, on the other hand, is set by the head loss formed by the flow calibration orifice 27, to which is added the sum of head losses encountered by the flowing fluid 11 on its path between the fluid chamber 5 and the outlet of the cylinder 4 opposite that chamber 5. It will be noted that the total energy loss due to said fluid flow 11 remains in all cases slight, since the pressure at which this flow occurs remains low.

Hence, the cooling and lubricating system 1 for a piston sealing device 2 according to the invention is able to provide a significant additional cooling and lubrication for the piston 3 at less energy cost, without jeopardizing the near perfect tightness and the low losses due to friction of the piston sealing device 2 as provided by the patent application FR 3009037.

The possibilities of the cooling and lubricating system 1 for a piston sealing device 2 according to the invention are not limited to the applications just described and it should furthermore be understood that the preceding description is given only as an example and in no way limiting the scope of said invention, which shall not be evaded by replacing the described details of its implementation with any equivalent ones.

The invention claimed is:

1. A cooling and lubricating system for a piston sealing device, wherein:

the piston sealing device is provided for a piston moving in a cylinder so as to form a fluid chamber, said piston comprising:

a piston head having a fixed skirt and comprising a piston bearing surface that exerts a force on a transmission element, and a compression surface that opens into the fluid chamber to receive pressure of a fluid;

wherein:

a sliding skirt is lodged in the cylinder with slight gap, in a prolongation of the piston head on a side with the compression surface and in an axis of said head, said sliding skirt is connected to said head by a mechanical interskirt connection, while a pressure transmission channel is devised inside the sliding skirt and passes through the sliding skirt in an axial direction, the piston sealing device further comprises a continuous extensible segment between the fixed skirt and the sliding skirt, said continuous extensible segment comprising an internal cylindrical segment face subjected to the pressure of the fluid via the pressure transmission channel, and an external cylindrical segment face that makes contact with the cylinder, an axial segment face on a fixed skirt side held directly or indirectly in tight contact with the fixed skirt and an axial segment face on a sliding skirt side held directly or indirectly in tight contact with the sliding skirt, even though a sliding skirt spring tends to bring the sliding skirt closer to the fixed skirt and to axially compress the continuous extensible segment, wherein said cooling and lubricating system comprises:

at least one sliding skirt thrust ring which prevents the sliding skirt from moving a certain distance away from the piston;

at least one flow valve traversed axially and in tight manner by the interskirt mechanical connection and inserted between the continuous extensible segment and the piston head, said valve comprising as a first part an axial valve face on the piston head side having a circular bearing surface for flow closure, the circular bearing surface for flow closure defining with a valve contact surface devised on the compression surface a circular contact line whose diameter is less than that of the cylinder, said valve comprising as a second part an axial valve face on the sliding skirt side held directly or indirectly in tight contact with the continuous extensible segment, said valve comprising as a third part a flow calibration orifice passing straight through said valve in the axial direction;

at least one intermediate fluid exit chamber whose volume is formed—inside the circular line of contact—by the axial valve face on the piston head side, by the compression surface, and by an external surface of the interskirt mechanical connection; and at least one valve return spring which tends to move the flow valve away from the piston head.

2. The cooling and lubricating system according to claim 1, wherein the valve return spring acts as a sliding skirt spring.

3. The cooling and lubricating system according to claim 1, wherein the flow calibration orifice consists of a gap left between the flow valve and the interskirt mechanical connection.

4. The cooling and lubricating system according to claim 1, wherein the valve return spring is lodged inside the intermediate fluid exit chamber.

5. The cooling and lubricating system according to claim 1, wherein the sliding skirt spring is lodged inside a spring cup devised in or attached to the sliding skirt.

6. The cooling and lubricating system according to claim 1, wherein the sliding skirt thrust ring is traversed straight through by at least one fluid passage orifice.

7. The cooling and lubricating system according to claim 1, wherein an external cylindrical face of the piston head has a circular decompression groove which limits the tightness of said head.

* * * * *